US009434200B2

(12) United States Patent
Nagoshi et al.

(10) Patent No.: US 9,434,200 B2
(45) Date of Patent: Sep. 6, 2016

(54) COATED PRINTING PAPER FOR INDUSTRIAL INKJET PRINTER AND METHOD FOR MANUFACTURING PRINTED PRODUCTS USING THE SAME

(71) Applicant: MITSUBISHI PAPER MILLS LIMITED, Tokyo (JP)

(72) Inventors: Masanori Nagoshi, Tokyo (JP); Jun Urasaki, Tokyo (JP)

(73) Assignee: MITSUBISHI PAPER MILLS LIMITED, Tokyo (JP)

( * ) Notice: Subject to any disclaimer, the term of this patent is extended or adjusted under 35 U.S.C. 154(b) by 0 days.

(21) Appl. No.: 14/437,111

(22) PCT Filed: Oct. 8, 2013

(86) PCT No.: PCT/JP2013/077368

§ 371 (c)(1),
(2) Date: Apr. 20, 2015

(87) PCT Pub. No.: WO2014/069189

PCT Pub. Date: May 8, 2014

(65) Prior Publication Data

US 2015/0283840 A1 Oct. 8, 2015

(30) Foreign Application Priority Data

Oct. 29, 2012 (JP) ..... 2012-237393
Aug. 9, 2013 (JP) ..... 2013-165743

(51) Int. Cl.
*B41M 5/50* (2006.01)
*B41M 5/41* (2006.01)
(Continued)

(52) U.S. Cl.
CPC . *B41M 5/41* (2013.01); *B41J 2/01* (2013.01); *B41J 11/0015* (2013.01);
(Continued)

(58) Field of Classification Search
CPC .... B41M 5/52; B41M 5/508; B41M 5/5218; B41M 5/5254
See application file for complete search history.

(56) References Cited

U.S. PATENT DOCUMENTS 6,432,517 B1 8/2002 Yokota et al.
2004/0255820 A1* 12/2004 Chen ..... B41M 5/52 106/31.13
(Continued)

FOREIGN PATENT DOCUMENTS

JP 2001-063206 A 3/2001
JP 2004-114487 A 4/2004
(Continued)

OTHER PUBLICATIONS

Michiko Tokumasu "Inkjet Printer Compatible with B2 Wide Format Printing Paper" Japan Printer, Insatsu Gakkai Shuppanbu Ltd., Aug. 2010, vol. 93, pp. 21-24.
(Continued)

*Primary Examiner* — Betelhem Shewareged
(74) *Attorney, Agent, or Firm* — Birch, Stewart, Kolasch & Birch, LLP

(57) ABSTRACT

The present invention provides a coated printing paper which is for use in an industrial inkjet printing machine and which has printability that can accommodate the printing speed of an industrial inkjet printing machine while having printability for a conventional printing machine such as an offset press. The present invention provides a coated printing paper for an industrial inkjet printing machine, which comprises: a base paper at least containing a boric acid compound or a borate compound; and on the base paper, a coating layer at least containing polyvinyl alcohol and ground calcium carbonate having a mean particle diameter of 0.1 μm to 0.28 μm.

11 Claims, 1 Drawing Sheet

(51) Int. Cl.

| | |
|---|---|
| ***B41M 5/52*** | (2006.01) |
| ***D21H 19/38*** | (2006.01) |
| ***D21H 19/60*** | (2006.01) |
| ***D21H 17/65*** | (2006.01) |
| ***B41J 2/01*** | (2006.01) |
| ***B41J 11/00*** | (2006.01) |

(52) U.S. Cl.
CPC ..... *B41M 5/508* (2013.01); *B41M 5/52* (2013.01); *B41M 5/5218* (2013.01); *B41M 5/5254* (2013.01); *D21H 17/65* (2013.01); *D21H 19/38* (2013.01); *D21H 19/385* (2013.01); *D21H 19/60* (2013.01); *B41M 2205/40* (2013.01)

(56) References Cited

U.S. PATENT DOCUMENTS

2008/0241437 A1* 10/2008 Nakano ..... B41M 5/502 428/32.25
2010/0092678 A1* 4/2010 Zeng ..... B41M 5/5218 427/288
2012/0107531 A1* 5/2012 Idei ..... D21H 19/385 428/32.31

FOREIGN PATENT DOCUMENTS

| | | | | |
|---|---|---|---|---|
| JP | 2004-232150 | A | 8/2004 | |
| JP | 2004-237650 | A | 8/2004 | |
| JP | 2005/088525 | A | 4/2005 | |
| JP | 2006-281609 | A | 10/2006 | |
| JP | 2011-251231 | A | 12/2011 | |
| WO | WO 2011/001955 | A1 * | 1/2011 | ..... B41M 5/50 |

OTHER PUBLICATIONS

Yasutoshi Miyagi "Offset Quality Inkjet Printer" Japan Printer, Insatsu Gakkai Shuppanbu Ltd., Aug. 2010, vol. 93, pp. 25-29.

* cited by examiner

COATED PRINTING PAPER FOR INDUSTRIAL INKJET PRINTER AND METHOD FOR MANUFACTURING PRINTED PRODUCTS USING THE SAME

TECHNICAL FIELD

The present invention relates to a coated printing paper for printing using an industrial inkjet printer. In addition, the present invention relates to a method for manufacturing printed products using an industrial inkjet printer.

BACKGROUND ART

The technology of inkjet recording systems has progressed rapidly, and industrial inkjet printers are known that employ inkjet recording systems in industrial or commercial printers for manufacturing large volumes of commercial printed products (see, for example, Patent documents 1 and 2 and Non-patent documents 1 and 2). Industrial inkjet printers are marketed under trade names such as Truepress Jet manufactured by Dainippon Screen Mfg. Co., Ltd., the MJP Series manufactured by Miyakoshi Printing Machinery Co., Ltd., Prosper and Versamark manufactured by Eastman Kodak Co., and JetPress manufactured by Fujifilm Corp.

Although dependent on various printing conditions, these industrial inkjet printers feature color printing speeds that are ten to several tens of times faster than inkjet printers for home and SOHO use as well as wide format inkjet printers, demonstrating printing speeds of 15 m/min or faster and exceeding 60 m/min in the case of high-speed printers. Consequently, industrial inkjet printers are distinguished from inkjet printers for home and SOHO use and wide format inkjet printers.

Since industrial inkjet printers are able to handle variable information, they can be adapted to on-demand printing. There are many cases in which printing firms adopt a system by which fixed information is printed with conventional printers such as gravure printers, offset printers, letterpress printers, flexographic printers, thermal transfer printers or toner printers, and variable information is printed with industrial inkjet printers.

However, coated paper for offset printing and other conventional coated printing paper have inadequate printability with respect to, for example, inadequate ink fixation or ink absorption capacity for industrial inkjet printers. Consequently, image soiling and other problems occur, thereby preventing the obtaining of adequate image quality for marketing as a commercial product. Conventional inkjet printer paper has inadequate printability with respect to, for example, inadequate coating layer strength for offset printers and other conventional printers. Consequently, printing defects such as blanket piling occur during use with offset printers, thereby preventing the obtaining of adequate image quality for marketing as a commercial product. In addition, since conventional inkjet printer paper is not manufactured for use at printing speeds like those of industrial inkjet printers, they have inadequate printability in terms of inadequate ink adsorption rate or inadequate dot diffusion of ink droplets for industrial inkjet printers. Consequently, image soiling or white streaks on solid printed regions occur, thereby preventing the obtaining of adequate image quality for marketing as a commercial product.

Here, dot diffusion refers to a level of quality in which gaps between ink droplets are filled in as a result of ink droplets adequately diffusing after having impacted coated paper.

PRIOR ART DOCUMENTS

Patent Documents

Patent document 1: Japanese Unexamined Patent Publication No. 2011-251231

Patent document 2: Japanese Unexamined Patent Publication No. 2005-088525

Non-Patent Documents

Non-patent document 1: Michiko Tokumasu: "Inkjet Printer Compatible with B2 Wide Format Printing Paper" (Japan Printer, Insatsu Gakkai Shuppanbu Ltd., August 2010 (Vol. 93), pp. 21-24)

Non-patent document 2: Yasutoshi Miyagi: "Offset Quality Inkjet Printer" (Japan Printer, Insatsu Gakkai Shuppanbu Ltd., August 2010 (Vol. 93), pp. 25-29)

DISCLOSURE OF THE INVENTION

Problems to be Solved by the Invention

Due to the aforementioned problems, coated printing paper for industrial inkjet printers has yet to be established. There is a particular need for coated printing paper having printability with respect to both industrial inkjet printers and conventional printers such as offset printers. In addition, a method for using an industrial inkjet printer to manufacture printed products capable of being marketed as commercial products has also yet to be adequately established. In particular, a method for manufacturing printed products capable of being marketed as commercial products such as brochures, catalogs or pamphlets, which require a higher level of image quality in comparison with advertising leaflets and the like that are unconcerned with image quality, has also yet to be adequately established.

A first object of the present invention is to provide coated printing paper for an industrial inkjet printer that has printability with respect to offset printers and other conventional printers, allows the obtaining of adequate image quality for marketing as a commercial product, and also has printability with respect to industrial inkjet printers, and allows the obtaining of adequate image quality for marketing as a commercial product. In addition, a second object of the present invention is to provide a method for manufacturing printed products with an industrial inkjet printer using this coated printing paper.

Means for Solving the Problems

The first object of the present invention is achieved by coated printing paper for an industrial inkjet printer that has a base paper at least containing a boric acid compound or a borate compound, and, on the base paper, a coating layer at least containing polyvinyl alcohol and ground calcium carbonate having a mean particle diameter of 0.1 μm to 0.28 μm.

Consequently, coated printing paper for an industrial inkjet printer can be provided that has printability with respect to offset printers and other conventional printers, and also has printability with respect to industrial inkjet printers. As a result, image quality can be obtained that is adequate for marketing as a commercial product.

In addition, the second object of the present invention is achieved by a method for manufacturing printed products that includes printing using an industrial inkjet printer having a printing speed of 60 m/min or more on the aforementioned coated printing paper for an industrial inkjet printer.

As a result, printed products capable of being marketed as commercial products can be produced by printing using an industrial inkjet printer.

BEST MODE FOR CARRYING OUT THE INVENTION

Figure 1:
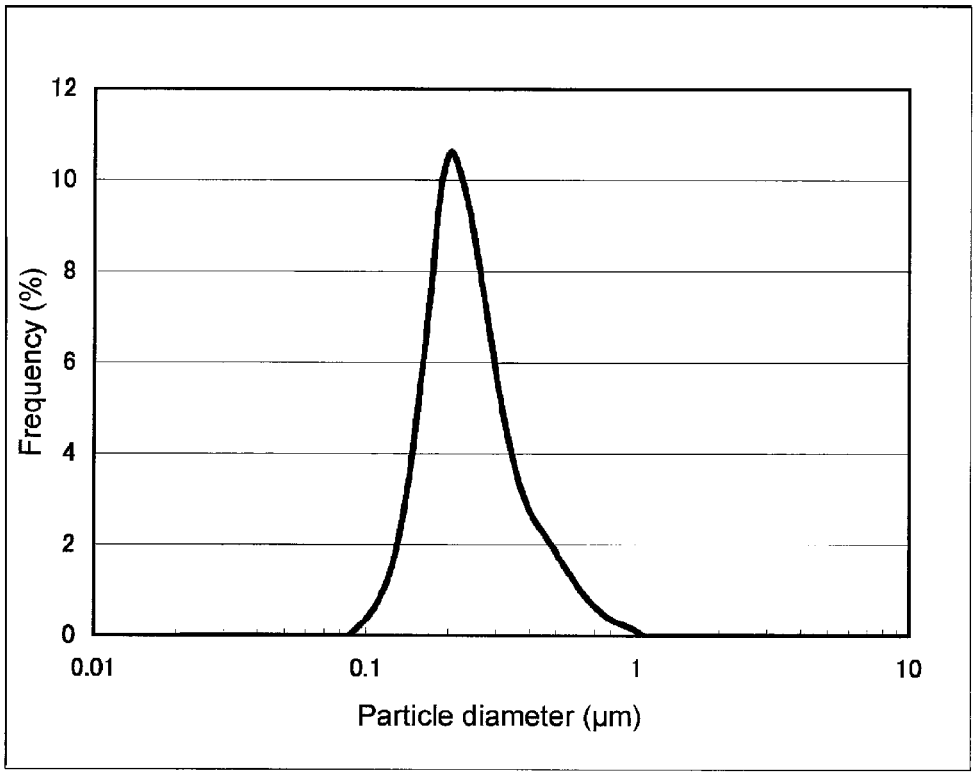
FIG. 1 shows a particle size distribution chart of ground calcium carbonate used in Example 1.

The following provides a detailed explanation of the present invention.

Industrial inkjet printers consist of rotary printing paper types and cut sheet types according to the difference in the manner in which the paper is fed. The types of ink installed consist of water-based dye ink, in which a dye is used for the colorant, and water-based pigment ink, in which a pigment is used for the colorant. In the present invention, there are no particular limitations on the manner in which paper is fed or on the ink type of the industrial inkjet printer.

In the case both variable information and fixed information are present in an image to be printed, all or a portion of the fixed information is preferably printed using a conventional printer such as a gravure printer, offset printer, letterpress printer, flexographic printer, thermal transfer printer or toner printer. An offset printer is particularly preferable from the viewpoint of manufacturing cost and print quality. Printing with a conventional printer may be carried out before or after printing using an industrial inkjet printer. In the case image areas of variable information and fixed information are overlapping, since there are cases in which the portion for industrial inkjet printing is covered by ink of the conventional printer making it difficult to recognize visually, printing using an industrial inkjet printer is preferably carried out afterwards. However, if printing using a conventional printer is carried out prior to printing using an industrial inkjet printer, there are cases in which the ink absorption capacity of the coated paper may be insufficient due to the coating layer of the coated paper being covered by ink of the conventional printer. Thus, it is necessary to further enhance the ink absorption capacity of the coated paper with respect to the industrial inkjet printer.

In the present invention, the conventional printer is, for example, a gravure printer, offset printer, letterpress printer, flexographic printer, thermal transfer printer or toner printer.

Gravure printers are printers that employ a process by which ink is transferred to a printing substrate via a roll-shaped plate cylinder having an image engraved therein.

Offset printers are printers that employ an indirect printing process by which ink is first transferred to a blanket and the transferred ink is then transferred to a printing substrate.

Letterpress printers are printers that employ a relief printing process by which ink imparted to a relief printing plate is subjected to pressure while being pressed against a printing substrate.

Flexographic printers are printers that employ a relief printing process using a flexible, elastic resin plate.

Thermal transfer printers are printers that use various colors of ink ribbons and employ a process by which a colorant is transferred from an ink ribbon to the printing substrate by heat.

Toner printers are printers that employ an electrographic process by which toner adhered to an electrostatic drum is transferred to a printing substrate utilizing static electricity.

In the present invention, "adequate image quality for marketing as a commercial product" refers to the absence of the occurrence of soiling of the images of printed products caused by separation of the coating layer, defective ink fixation or defective toner fixation following printing, or soiling or bleeding of images of printed products caused by insufficient ink absorption rate or ink absorption capacity. Moreover, "adequate image quality for marketing as a commercial product" includes the absence of the occurrence of white streaks in the printed portions of printed products caused by defective dot diffusion of ink droplets that have impacted a printing substrate in the case of industrial inkjet printers, as well as the absence of the occurrence of blanket piling in the case of offset printers. "Printed products capable of being marketed as commercial products" refer to printed products having "adequate image quality for marketing as a commercial product".

In the present invention, the printing speed of the industrial inkjet printer is 60 m/min or more. Although industrial inkjet printing is possible even at a printing speed slower than the aforementioned printing speed, the printing speed at which the effects of the present invention are prominently observed is 60 m/min or more. Productivity of 60 m/min or more is also preferable since productivity is emphasized from the viewpoint of industrial use. In the case of cut sheets, printing speed is calculated from the paper size printed per minute.

The coated printing paper for an industrial inkjet printer of the present invention has a base paper and a coating layer. In the present invention, the coating layer of the coated printing paper for an industrial inkjet printer contains ground calcium carbonate having a mean particle diameter of 0.1 μm to 0.28 μm as pigment.

In the present invention, the ground calcium carbonate preferably does not contain particles having a particle diameter greater than 1.5 μm. The reason for this is that the occurrence of image soiling of printed products in industrial inkjet printing can be further inhibited.

In the case mean particle diameter does not fall within the aforementioned range, printability with respect to industrial inkjet printers is not obtained and adequate image quality for marketing as a commercial product cannot be obtained for printed products.

In the present invention, mean particle diameter refers to the mean particle diameter of single particles in the case of single particles, or mean particle diameter of aggregated particles in the case of forming secondary particles or other aggregated particles. The mean particle diameter and half value width of the maximum peak on a particle size distribution curve of ground calcium carbonate can be calculated from the state in which it has become coated paper. An example of a method thereof consists of capturing an electron micrograph of the surface of the coated printing paper using a scanning electron microscope equipped with an elemental analysis function such as an energy dispersive X-ray spectrometer, calculating particle diameter of the photographed particles by assuming the photographed particles as spheres having cross-section areas approximately equal to the particle image areas shown in the photographed image, and measuring 100 particles present in a photographed image to determine a mean particle diameter. A particle size distribution curve, in which frequency (%) is plotted on the vertical axis and particle diameter (m) is plotted on the horizontal axis, can be obtained from particle diameter data measured from 100 particles using particle image analysis software. Half value width can be determined from the resulting particle size distribution curve as the width at ½ the height of the peak height of the maximum peak.

The mean particle diameter and half value width of the maximum peak can also be determined by measuring using a laser diffraction/scattering method or dynamic light scattering method. In that case, particle size distribution refers to the particle size distribution based on volume as measured with a laser diffraction/scattering particle size analyzer. Mean particle diameter refers to the mean particle diameter based on measurement of volume-based particle size distribution using a laser diffraction/scattering method or dynamic light scattering method. Mean particle diameter refers to the mean particle diameter of single particles in the case of single particles, or mean particle diameter of aggregated particles in the case of forming secondary particles or other aggregated particles. Mean particle diameter and the half value width of the maximum peak on a particle size distribution curve can be calculated from the resulting particle size distribution. For example, particle size distribution, mean particle diameter and the half value width of the maximum peak on a particle size distribution curve can be calculated by measuring particle size distribution using the Microtrac MT3300EXII laser diffraction/scattering particle size distribution analyzer manufactured by Nikkiso Co., Ltd.

The maximum peak refers to a single peak or the highest peak among a plurality of peaks. When the half value width of the maximum peak is small, it means that the particle size distribution curve has a well-defined maximum peak.

In the present invention, ground calcium carbonate having a mean particle diameter of 0.1 μm to 0.28 μm preferably has at least one peak and a half value width of the maximum peak of 0.25 μm or less in a particle size distribution curve thereof. As a result of the half value width satisfying this condition, coated printing paper for an industrial inkjet printer has printability with respect to a conventional printer such as an offset printer and also has more favorable printability with respect to an industrial inkjet printer.

Figure 2:
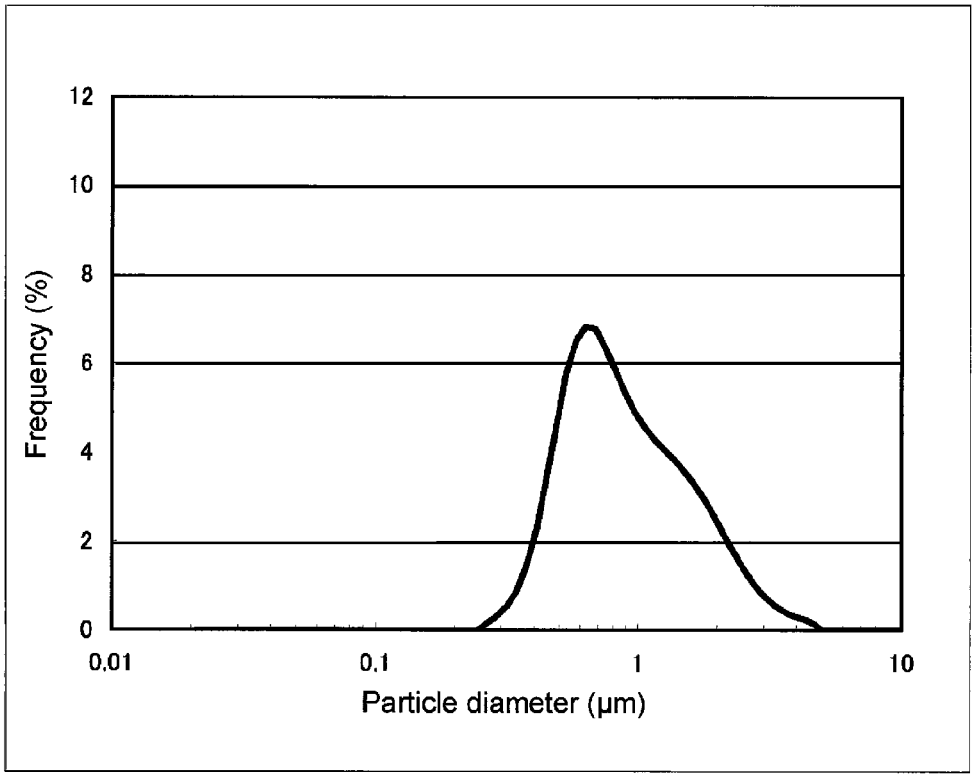
FIG. 2 shows a particle size distribution chart of a commercially available ground calcium carbonate product used in Comparative example 7.

FIG. 1 indicates an example of a particle size distribution curve of ground calcium carbonate having a mean particle diameter of 0.1 μm to 0.28 μm that has at least one peak and the half value width of the maximum peak of 0.25 μm or less. FIG. 2 indicates an example of a particle size distribution curve of ground calcium carbonate conventionally known in the field of coated paper.

Ground calcium carbonate is manufactured by crushing natural limestone. Thus, even though mean particle diameter may be roughly the same, particle size distribution is not the same. In general, ground calcium carbonate demonstrates a particle size distribution curve that does not have a well-defined peak or has a broad peak. The ground calcium carbonate according to the present invention is distinguished from conventionally known ground calcium carbonate in that it consists of fine particles such that the mean particle diameter is 0.1 μm to 0.28 μm, and has a well-defined maximum peak.

In the present invention, the coating layer can contain a conventionally known pigment in addition to the ground calcium carbonate. Examples of conventionally known pigments include various types of kaolin, clay, talc, precipitated calcium carbonate, satin white, lithopone, titanium oxide, zinc oxide, silica, colloidal silica, alumina, aluminum hydroxide and plastic pigments.

In the present invention, the content of the ground calcium carbonate according to the present invention in the coating layer is preferably 60 parts by mass or more based on 100 parts by mass for the total amount of pigment in the coating layer. If the ground calcium carbonate in the coating layer is 60 parts by mass or more based on 100 parts by mass for the total amount of pigment in the coating layer, more favorable printability with respect to an industrial inkjet printer can be obtained for the coated printing paper for an industrial inkjet printer.

The ground calcium carbonate having the mean particle diameter according to the present invention can be manufactured using, for example, the method indicated below. First, a preliminary dispersed slurry of ground calcium carbonate is prepared by dispersing a powder, obtained by dry-crushing natural limestone, in water or an aqueous solution to which has been added a dispersant. The preliminary dispersed slurry prepared in this manner is then further wet-crushed using a bead mill and the like. Here, the natural limestone can also be wet-crushed directly. However, dry crushing is preferably carried out in advance prior to wet crushing from the viewpoint of productivity. During dry crushing, the natural limestone is crushed preferably to a degree that the particle diameter thereof is 40 mm or less, and more preferably to a mean particle diameter of 2 μm to 2 mm. During wet crushing, particle diameter is preferably adjusted by carrying out granulating the particle size at an intermediate stage. Granulating can be carried out with a commercially available granulating machine.

Next, an organic dispersant is preferably applied to the surface of the aforementioned crushed limestone. Although this can be carried out by various methods, it is preferably carried out by a method consisting of wet crushing the dry-crushed limestone in the presence of an organic dispersant. More specifically, an aqueous medium is added to the limestone such that the weight ratio of limestone/aqueous medium (preferably water) is 30/70 to 85/15 and preferably 60/40 to 80/20 followed by addition of the organic dispersant thereto. Examples of organic dispersants include low molecular weight or high molecular weight water-soluble anionic surfactants having a carboxylate, sulfate, sulfonate or phosphate group as a functional group thereof, and polyethylene glycol-based or polyhydric alcohol-based nonionic surfactants. The organic dispersant is particularly preferably a water-soluble anionic surfactant having polyacrylic acid in the form of a polyacrylic acid-based organic dispersant. These organic dispersants are commercially available from manufacturers such as San Nopco Ltd., Toagosei Co., Ltd. or Kao Corp., and these can be used in the present invention. Although there are no particular limitations on the amount of organic dispersion used, it is preferably used within a range of 0.3 parts by mass to 3.5 parts by mass, and more preferably used within a range of 0.5 parts by mass to 3 parts by mass, as the solid fraction per 100 parts by mass of the ground calcium carbonate. The resulting preliminary dispersed slurry is wet-crushed according to a conventionally known method. Alternatively, an aqueous medium, obtained by preliminarily dissolving an organic dispersant in an amount within the aforementioned range, is mixed with limestone followed by wet-crushing according to a conventionally known method. Wet crushing can be carried out in batches or continuously with an apparatus such as a mill using a crushing medium in the manner of a sand mill, attritor or ball mill and the like. As a result of wet crushing in this manner, ground calcium carbonate can be obtained having a mean particle diameter of 0.1 μm to 0.28 μm. Moreover, by granulating to obtain the prescribed half value width, ground calcium carbonate can be obtained having at least one peak and the half value width of the maximum peak of 0.25 μm or less in the particle size distribution curve thereof. Here, the method used to obtain ground calcium carbonate having the mean particle diameter according to the present invention is not limited to the aforementioned method.

The coating layer of the coated printing paper for an industrial inkjet printer in the present invention contains a binder in the form of polyvinyl alcohol. Examples of the polyvinyl alcohol according to the present invention include polyvinyl alcohols having various degrees of saponification or various degrees of polymerization, as well as silanol-modified polyvinyl alcohol introduced with a silanol group, carboxylic acid-modified polyvinyl alcohol introduced with a carboxyl group, cation-modified polyvinyl alcohol introduced with a cationic polymer or monomer, and alkyl-modified polyvinyl alcohol introduced with an alkyl group.

The degree of saponification of the polyvinyl alcohol is preferably 80 mol % to less than 99.5 mol %. The degree of polymerization of the polyvinyl alcohol is preferably 500 to 4000. The reason for this is that the liquid stability of the coating layer-coating color and coating layer strength are more favorable.

The coating layer can contain a conventionally known binder in addition to the polyvinyl alcohol. Examples of binders include polyacrylic acid-based binders such as sodium polyacrylate or polyacrylamide, polyvinyl acetate-based binders, various types of copolymer latex such as styrene-butadiene copolymer or ethylene-vinyl acetate, polyethylene oxide, formalin resins such as urea or melamine, and water-soluble synthetic products such as polyethyleneimine, polyamidopolyamine or epichlorhydrin. Additional examples of binders include starches purified from natural plants, hydroxyethyl starch, oxidized starch, starch ether, starch phosphate, enzyme modified starch and cold water-soluble starch obtained by flash drying the aforementioned starches, natural polysaccharides and oligomers thereof such as dextrin, mannan, chitosan, arabinogalactan, glycogen, inulin, pectin, hyaluronic acid, carboxymethyl cellulose or hydroxyethyl cellulose, and modified forms thereof. Other examples of binders include natural proteins and modified forms thereof such as casein, gelatin, soybean protein or collagen, and synthetic polymers and oligomers such as polylactic acid or peptides. These can be used alone or in combination. The binder can be used after undergoing cationic modification. Since there are cases in which printability may decrease from the viewpoint of ink absorption capacity during industrial inkjet printing if the binder is incorporated in excess with respect to the pigment, the content of the binder in the coating layer is preferably 3 parts by mass to 30 parts by mass, and more preferably 5 parts by mass to 20 parts by mass, based on 100 parts by mass of the total amount of the solid pigment fraction contained in the coating layer. The content of the polyvinyl alcohol is preferably 60 parts by mass or more based on 100 parts by mass for the total amount of binder in the coating layer.

In the present invention, the coating layer of coated printing paper for an industrial inkjet printer can contain various types of conventionally known assistants ordinarily used in the field of coated paper as necessary in addition to the ground calcium carbonate and polyvinyl alcohol according to the present invention. Examples of various types of assistants include organic pigments, ink fixing agents, dispersants, thickener, fluidity improving agents, printability improvers, surfactants, defoamers, antifoamers, releasing agents, foaming agents, penetrants, coloring dyes, coloring pigments, optical brighteners, ultraviolet absorbers, antioxidants, preservatives, fungicides, insolubilizers, wet paper strengthening agents and dry paper strengthening agents.

In the present invention, the coated printing paper for an industrial inkjet printer can be obtained by coating a coating layer-coating color on a base paper and drying. An ordinarily used coating apparatus can be used in the method for coating the coating layer-coating color onto the base paper, and there are no particular limitations thereon. Examples thereof include various types of coating apparatuses such as a roll coater, air knife coater, bar coater, various types of blade coaters such as a rod blade coater, short dwell coater or curtain coater. An ordinarily used drying apparatus can be used in the drying method, and there are no particular limitations thereon. Examples thereof include various types of drying apparatuses such as hot air dryers such as a linear tunnel dryer, arch dryer, an air loop dryer or sine curve air float dryer, and dryers using infrared rays, heat dryer or microwaves.

The base paper of the coating layer of the present invention at least contains a boric acid compound or borate compound. The base paper can be obtained by containing a boric acid compound or borate compound in raw paper. Examples of methods used to contain the boric acid compound or borate compound in raw paper include (1) a method consisting of adding a boric acid compound or borate compound to paper stock, and (2) a method consisting of coating or impregnating a treatment solution composition containing a boric acid compound or borate compound onto or into raw paper.

In the present invention, the method described in (2) above is preferable for the method used to contain a boric acid compound or borate compound in the raw paper. The reason for this is that stability and productivity of the paper stock are more favorable.

In the present invention, the raw paper refers to paper that is manufactured by using as main components thereof a conventionally known filler and wood pulp in the manner of chemical pulp such as leaf bleached Kraft pulp (LBKP) or needle bleached Kraft pulp (NBKP), mechanical pulp such as groundwood pulp (GP), pressure groundwood pulp (PGW), refiner mechanical pulp (RMP), thermomechanical pulp (TMP), chemithermomechanical pulp (CTMP), chemimechanical pulp (CMP) or chemi-groundwood pulp (CGP), or waste paper pulp such as de-inked pulp (DIP), mixing with one or more types of various types of additives such as binders, sizing agents, fixing agents, retention aids, cationizing agents or paper strengthening agents as necessary, and papermaking using various types of apparatuses such as a Fourdrinier papermaking machine, cylinder papermaking machine or twin wire papermaking machine.

In the present invention, a boric acid compound is the generic term for an oxygen acid formed by hydration of diboron trioxide. Examples of boric acid compounds include orthoboric acid ($H_3BO_3$), metaboric acid ($HBO_2$), hypoboric acid ($H_4B_2O_4$), tetraboric acid ($H_2B_4O_7$) and pentaboric acid ($H_2B_{10}O_{16}$).

In the present invention, a borate compound is the generic term for compounds represented by the following typical formula that are salts of oxygen acids having boron for the central atom thereof.

$$xM^1{}_2O.yB_2O_3.zH_2O$$

Here, $M^1$ represents the case of a monovalent metal ion and z includes zero.

Cases in which y/x is equivalent to ⅓, ½, 1, 2, 5/2 and 4 refer to orthoborates, diborates, metaborates, tetraborates, pentaborates and octaborates, respectively.

Examples of borate compounds include cobalt borate, zinc borate (such as zinc tetraborate or zinc metaborate), potassium aluminium borate, ammonium borate (such as ammonium metaborate, ammonium tetraborate, ammonium pentaborate or ammonium octaborate), cadmium borate (such as cadmium orthoborate or cadmium tetraborate), potassium borate (such as potassium metaborate, potassium tetraborate, potassium pentaborate, potassium hexaborate or potassium octaborate), silver borate (such as silver metaborate or silver tetraborate), copper borate (such as copper(II) borate, copper metaborate or copper tetraborate), sodium borate (such as sodium metaborate, sodium diborate, sodium tetraborate, sodium pentaborate, sodium hexaborate or sodium octaborate), lead borate (such as lead metaborate or lead hexaborate), nickel borate (such as nickel (II) orthoborate, nickel diborate, nickel tetraborate or nickel octaborate), barium borate (such as barium orthoborate, barium metaborate, barium diborate or barium tetraborate), bismuth borate, magnesium borate (such as magnesium orthoborate, magnesium diborate, magnesium metaborate, trimagnesium tetraborate or pentamagnesium tetraborate), manganese borate (such as manganese (I) borate, manganese metaborate or manganese tetraborate) and lithium borate (such as lithium metaborate, lithium tetraborate or lithium pentaborate). Additional examples of borate compounds include borate minerals such as borax, cahnite, inyoite, kotoite, suanite or szaibelyite.

Among these boric acid compounds and borate compounds, the boric acid compound is preferably orthoboric acid and the borate compound is preferably borax. Two or more types of boric acid compounds and borate compounds can be used in combination.

In the present invention, the content of the boric acid compound or borate compound in the base paper is preferably 0.15 $g/m^2$ to 4.0 $g/m^2$ in terms of the solid fraction as orthoboric acid ($H_3BO_3$). In the case of a method consisting of coating or impregnating a treatment solution composition, the content of the boric acid compound or borate compound is preferably 0.075 $g/m^2$ to 2.0 $g/m^2$ per side. If within this range, the coated printing paper for an industrial inkjet printer of the present invention has printability with respect to a conventional printer such as an offset printer while also having more favorable printability with respect to an industrial inkjet printer. Moreover, the occurrence of cracking of the coating layer can be inhibited.

In the present invention, the concentration of the boric acid compound or borate compound in a treatment solution composition is preferably 5% by mass to 30% by mass from the viewpoint of the problem of crystal precipitation in the treatment solution composition.

In the present invention, the treatment solution composition can contain various types of additives such as a surfactant, defoamer, thickener, color adjuster, optical brighteners, insolubilizer, dye fixing agent, antioxidant or ultraviolet absorber as necessary in addition to the boric acid compound or borate compound.

In the present invention, a known coating or impregnation method can be used to coat or impregnate the treatment solution composition containing the boric acid compound or borate compound onto or into raw paper. Examples thereof include methods using various types of size press apparatuses such as a vertical size press, horizontal size press, inclined side press, gate roll or bill-blade, and methods using various types of coating apparatuses such as an air knife coater, blade coater, rod blade coater, bar coater, reverse roll coater, comma coater, lip coater, die coater or curtain coater.

In the present invention, the surface of the raw paper, base paper or coated printing paper can be smoothened as necessary with a machine calender, soft nip calender, super calender, multistage calender or multi-nip calender and the like.

As a result of providing a coating layer, which at least contains the polyvinyl alcohol and ground calcium carbonate having the mean particle diameter according to the present invention, on a base paper containing a boric acid compound or borate compound, the resulting coated printing paper for an industrial inkjet printer demonstrates superior printability with respect to a conventional printer such as an offset printer while also demonstrating superior printability with respect to an industrial inkjet printer.

In the present invention, the coated printing paper for an industrial inkjet printer preferably has the coating layer according to the present invention on both sides of the base paper. As a result of providing the coating layer on both sides, paper quality comparable to that of CWF paper can be obtained on both sides.

Another aspect of the present invention is a method for manufacturing printed products that includes printing using an industrial inkjet printer having a printing speed of 60 m/min or more on the coated printing paper for an industrial inkjet printer according to the present invention. According to this method for manufacturing printed products, printed products favorable for an industrial inkjet printer can be manufactured with superior productivity. In addition, printed products can be printed using a conventional printer in the manner of an offset printer either before or after printing using an industrial inkjet printer.

EXAMPLES

The following provides a more detailed explanation of the present invention through examples thereof. Furthermore, the present invention is not limited to the following examples provided the gist thereof is not exceeded. The terms parts by mass, percent by mass (mass %) and percent by volume (vol %) indicated in the examples indicate the values of dried solid fractions or substantial components.

<Measurement of Particle Size Distribution and Half Value Width of Maximum Peak>

Mean particle diameter was calculated by capturing a photograph of the surface of coated printing paper obtained in the manner described below using a scanning electron microscope (JSM-6490LA, JEOL Ltd.), calculating particle diameter of the photographed particles from the photographed image by assuming the photographed particles as spheres having cross-section areas approximately equal to the particle image areas shown in the photographed image, and measuring 100 particles present in a photographed image. A particle size distribution curve, in which frequency (%) is plotted on the vertical axis and particle diameter (μm) is plotted on the horizontal axis, is obtained from particle diameter data measured from 100 particles using particle image analysis software. Half value width can be determined from the resulting particle size distribution curve as the width at ½ the height of the peak height of the maximum peak. Mean particle diameters and maximum peak half value widths are shown in Table 1.

<Preparation of Ground Calcium Carbonate>

Ground calcium carbonate was prepared as follows. Natural limestone was coarsely crushed to a mean particle diameter of about 30 μm with a jaw crusher, hammer crusher and roller mill, granulated as necessary, and added thereto water and a commercially available polyacrylic acid-based dispersant followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m), followed by granulating as necessary. The beads used consisted of zirconia beads having a diameter of about 0.2 mm. The bead packing ratio was varied over the range of 80% by volume to 85% by volume. The flow rate was set to about 15 liters/min, and the number of passes was varied. The aforementioned procedure was used to prepare ground calcium carbonate having various mean particle diameters and half value widths.

The ground calcium carbonate prepared in this manner was used to manufacture the coated printing paper of Examples 1 to 10 and Comparative examples 1 to 5. Here, a particle size distribution chart of the ground calcium carbonate used in Example 1 is shown in FIG. 1.

<Production of Raw Paper>

10 parts by mass of filler in the form of precipitated calcium carbonate, 0.8 parts by mass of amphoteric starch, 0.8 parts by mass of aluminum sulfate and 1.0 parts by mass of alkyl ketene dimer sizing agent (Sizepine K903, Arakawa Chemical Industries, Ltd.) were added to a pulp slurry composed of 100 parts by mass of LBKP having freeness of 400 mlcsf followed by forming into paper using a Fourdrinier papermaking machine to obtain paper. Oxidized starch was adhered to both sides of this paper at 2.5 g/m$^2$ with a size press followed by processing with a machine calender to obtain raw paper having a basis weight of 100 g/m$^2$.

<Preparation of Treatment Solution Composition>

40 parts by mass of orthoboric acid ($H_3BO_3$) and 40 parts by mass of a borate compound in the form of borax ($Na_2B_4O_7.10H_2O$) were dissolved in 420 parts by mass of water to prepare a treatment solution composition in which the weight ratio of boric acid/borax was 1/1.

<Production of Base Paper 1>

The treatment solution composition was coated onto the aforementioned raw paper using an air knife coater so that the adhered amount after drying was 1 g/m$^2$ per side followed by drying using a hot air dryer and calendering using a soft calender to produce Base Paper 1.

<Production of Base Paper 2>

Base Paper 2 was produced by calendering the aforementioned raw paper using a soft calender.

<Production of Base Paper 3>

10 parts by mass of filler in the form of precipitated calcium carbonate, 0.8 parts by mass of amphoteric starch, 0.8 parts by mass of aluminum sulfate, 1.0 parts by mass of alkyl ketene dimer sizing agent (Sizepine K903, Arakawa Chemical Industries, Ltd.) and 2.3 parts by mass of orthoboric acid ($H_3BO_3$) were added to a pulp slurry composed of 100 parts by mass of LBKP having freeness of 400 mlcsf followed by forming into paper using a Fourdrinier papermaking machine to obtain paper. Oxidized starch was adhered to both sides of this paper at 2.5 g/m$^2$ with a size press followed by processing with a machine calender to produce Base Paper 3 having a basis weight of 100 g/m$^2$.

In the production of Base Paper 3, the boric acid acted on the pulp and the amphoteric starch when the orthoboric acid ($H_3BO_3$) was added to the pulp slurry, causing decreased dispersion stability of the pulp slurry and poor productivity.

<Preparation of Coating Layer-Coating Colors>

The coating layer-coating colors used to manufacture the coated printing paper of Examples 1 to 10 and Comparative examples 1 to 4, 6 and 7 were prepared according to the contents indicated below with the exception of Comparative example 5.

| | |
|---|---|
| Ground calcium carbonate and other pigment | Incorporated amounts shown in Table 1 |
| Polyvinyl alcohol (PVA117, Kuraray Co., Ltd.) | 12 parts by mass |
| Styrene-butadiene copolymer latex (JSR-2605G, JSR Corp.) | 8 parts by mass |

The aforementioned components were mixed and dispersed in water and adjusted to a concentration of 40% by mass.

The coating layer-coating color used to manufacture the coated printing paper of Comparative example 5 was prepared according to the contents indicated below.

| | |
|---|---|
| Ground calcium carbonate and other pigment | Incorporated amounts shown in Table 1 |
| Styrene-butadiene copolymer latex (JSR-2605G, JSR Corp.) | 20 parts by mass |

The aforementioned components were mixed and dispersed in water and adjusted to a concentration of 40% by mass.

The other pigments shown in Table 1 are as indicated below.

Precipitated calcium carbonate (TP123, Okutama Kogyo Co., Ltd., mean particle diameter: 0.63 μm)

Kaolin (HG90, J.M.Huber Corp., mean particle diameter: 0.19 μm)

Silica (colloidal silica MP-2040, Nissan Chemical Industries, Ltd., mean particle diameter: 0.2 μm)

Ground calcium carbonate used in Comparative example 7 (FMT-OP2A, Fimatec, Ltd., mean particle diameter: 0.73 μm, half value width: 1.1 μm)

The particle size distribution chart of the commercially available ground calcium carbonate used in Comparative example 7 is shown in FIG. 2.

The coated printing paper of Examples 1 to 10 and Comparative examples 1 to 7 were produced according to the procedure described below.

<Production of Coated Printing Paper>

A coating layer-coating color was coated onto a base paper with a blade coater and dried followed by subjecting to calendering treatment to produce coated printing paper. The coating weight was 10 g/m$^2$ per side. The types of base paper of the coated printing paper of Examples 1 to 10 and Comparative examples 1 to 7 are shown in Table 1.

<Printing Using Offset Printer>

Printed products were manufactured by repeatedly printing prescribed evaluation images out 6000 m using an offset form rotary press manufactured by Miyakoshi Printing Machinery Co., Ltd. for the offset printer under conditions: a printing speed of 150 m/min, using T & K Toka UV Best Cure Black and Bronze Red Ink for the ink, and two UV irradiation sources at 8 kW.

<Printing Using Industrial Inkjet Printer>

Printed products were manufactured by printing prescribed evaluation images out 6000 m using the Prosper 5000XL Press manufactured by Eastman Kodak Co. for the industrial inkjet printer under conditions: two levels of printing speeds of 75 m/min and 100 m/min, using water-based dye ink.

<Evaluation of Printed Products>

Images of the printed products obtained in the manner described above were subjected to sensory evaluations to one of the four levels indicated below by visually evaluating the image quality of the printed products with respect to whether or not image quality of the printed products decreases accompanying printability with respect to the offset printer and industrial inkjet printer, and whether or not the printed products have adequate image quality for marketing as commercial products. In the present invention, an evaluation of AA or A was considered to constitute a printed product that demonstrates the effects of the present invention.

AA: No decrease in image quality and having adequate image quality for marketing as a commercial product regardless of the application A: Slight decrease in image quality and having adequate image quality for marketing as a commercial product regardless of the application B: Decrease in image quality, and not having adequate image quality for marketing as a commercial product depending on the application C: Decrease in image quality and not having adequate image quality for marketing as a commercial product regardless of the application The respective evaluation results for Examples 1 to 10 and Comparative examples 1 to 7 are shown in Table 1.

As is clear from Table 1, Examples 1 to 10, which constitute printed coating paper for an industrial inkjet printer of the present invention, had printability with respect to both a conventional printer such as an offset printer and an industrial inkjet printer, and allowed the manufacturing of printed products having image quality adequate for marketing as a commercial product. On the other hand, Comparative examples 1 to 7, which do not constitute printed coating paper for an industrial inkjet printer of the present invention, did not demonstrate such printability and did not allow the manufacturing of printed products having adequate image quality for marketing as a commercial product.

The invention claimed is:

1. Coated printing paper for an industrial inkjet printer, which comprises a base paper at least containing a boric acid compound or a borate compound, and on the base paper, a coating layer at least containing polyvinyl alcohol and ground calcium carbonate having a mean particle diameter of 0.1 μm to 0.28 μm.

2. The coated printed paper for an industrial inkjet printer according to claim 1, wherein the base paper at least containing a boric acid compound or a borate compound is formed by coating or impregnating a treatment solution composition at least containing a boric acid compound or a borate compound onto or into at least one side of raw paper.

3. The coated printed paper for an industrial inkjet printer according to claim 1, wherein the boric acid compound is orthoboric acid and the borate compound is borax.

4. The coated printed paper for an industrial inkjet printer according to claim 1, wherein the ground calcium carbonate having a mean particle diameter of 0.1 μm to 0.28 μm has at least one peak and a half value width of a maximum peak of 0.25 μm or less in a particle size distribution curve thereof.

TABLE 1

| | | Coating layer | | | | | | | Industrial inkjet printability | |
|---|---|---|---|---|---|---|---|---|---|---|
| | Base paper | Ground calcium carbonate mean particle diameter (μm) | Maximum peak half value width (μm) | Incorporated amount (parts by mass) | Type of other pigment | Mean particle diameter (μm) | Incorporated amount (parts by mass) | Offset printability | 75 m/min | 100 m/min |
| Example 1 | 1 | 0.20 | 0.16 | 100 | None | — | 0 | AA | AA | AA |
| Example 2 | 1 | 0.12 | 0.11 | 100 | None | — | 0 | AA | AA | AA |
| Example 3 | 1 | 0.28 | 0.24 | 100 | None | — | 0 | AA | AA | AA |
| Example 4 | 1 | 0.23 | 0.22 | 100 | None | — | 0 | AA | AA | AA |
| Example 5 | 1 | 0.19 | 0.15 | 100 | None | — | 0 | AA | AA | AA |
| Example 6 | 1 | 0.20 | 0.16 | 60 | Kaolin | 0.19 | 40 | A | A | A |
| Example 7 | 1 | 0.20 | 0.16 | 80 | Kaolin | 0.19 | 20 | AA | AA | A |
| Example 8 | 1 | 0.20 | 0.16 | 60 | Precipitated calcium carbonate | 0.63 | 40 | AA | AA | A |
| Example 9 | 3 | 0.20 | 0.16 | 100 | None | — | 0 | AA | AA | AA |
| Example 10 | 1 | 0.25 | 0.31 | 100 | None | — | 0 | A | A | A |
| Comparative example 1 | 2 | 0.20 | 0.16 | 100 | None | — | 0 | B | B | B |
| Comparative example 2 | 1 | 0.31 | 0.31 | 100 | None | — | 0 | B | B | C |
| Comparative example 3 | 1 | 0.50 | 0.45 | 100 | None | — | 0 | B | C | C |
| Comparative example 4 | 1 | 0.07 | 0.06 | 100 | None | — | 0 | C | B | B |
| Comparative example 5 | 1 | 0.20 | 0.16 | 100 | None | — | 0 | B | B | B |
| Comparative example 6 | 1 | — | — | 0 | Silica | 0.20 | 100 | C | C | C |
| Comparative example 7 | 1 | 0.79 | 1.1 | 100 | — | — | — | B | C | C |

5. A method for manufacturing printed products, comprising: printing using an industrial inkjet printer having a printing speed of 60 m/min or more on the coated printing paper for an industrial inkjet printer according to claim 1.

6. The coated printed paper for an industrial inkjet printer according to claim 2, wherein the boric acid compound is orthoboric acid and the borate compound is borax.

7. The coated printed paper for an industrial inkjet printer according to claim 2, wherein the ground calcium carbonate having a mean particle diameter of 0.1 μm to 0.28 μm has at least one peak and a half value width of a maximum peak of 0.25 μm or less in a particle size distribution curve thereof.

8. The coated printed paper for an industrial inkjet printer according to claim 3, wherein the ground calcium carbonate having a mean particle diameter of 0.1 μm to 0.28 μm has at least one peak and a half value width of a maximum peak of 0.25 μm or less in a particle size distribution curve thereof.

9. A method for manufacturing printed products, comprising: printing using an industrial inkjet printer having a printing speed of 60 m/min or more on the coated printing paper for an industrial inkjet printer according to claim 2.

10. A method for manufacturing printed products, comprising: printing using an industrial inkjet printer having a printing speed of 60 m/min or more on the coated printing paper for an industrial inkjet printer according to claim 3.

11. A method for manufacturing printed products, comprising: printing using an industrial inkjet printer having a printing speed of 60 m/min or more on the coated printing paper for an industrial inkjet printer according to claim 4.

* * * * *